United States Patent [19]

Fleissner

[11] 4,227,317

[45] Oct. 14, 1980

[54] APPARATUS FOR THE HEAT TREATMENT OF TEXTILES

[75] Inventor: Hans Fleissner, Egelsbach bei Frankfurt am Main, Fed. Rep. of Germany

[73] Assignee: Vepa Aktiengesellschaft, Fed. Rep. of Germany

[21] Appl. No.: 919,839

[22] Filed: Jun. 28, 1978

Related U.S. Application Data

[60] Division of Ser. No. 768,382, Feb. 14, 1977, Pat. No. 4,137,649, which is a continuation of Ser. No. 463,146, Apr. 22, 1974, abandoned.

[30] Foreign Application Priority Data

| | | | |
|---|---|---|---|
| Apr. 21, 1973 | [DE] | Fed. Rep. of Germany | 2320479 |
| Apr. 21, 1973 | [DE] | Fed. Rep. of Germany | 2320480 |
| Apr. 21, 1978 | [DE] | Fed. Rep. of Germany | 2320481 |
| Nov. 17, 1973 | [DE] | Fed. Rep. of Germany | 2357459 |

[51] Int. Cl.[3] ..... F26B 13/10

[52] U.S. Cl. ..... 34/155; 34/212; 34/217

[58] Field of Search ..... 34/212, 216, 217, 155

[56] References Cited

U.S. PATENT DOCUMENTS

| | | | |
|---|---|---|---|
| 1,213,549 | 1/1917 | Sibson et al. | 34/77 X |
| 3,158,447 | 11/1964 | Sable | 34/18 |
| 3,319,354 | 5/1967 | Hering, Jr. et al. | 34/155 |
| 3,374,106 | 3/1968 | Thygeson, Sr. | 34/212 X |
| 3,758,960 | 9/1973 | McCreary et al. | 34/46 X |
| 3,817,160 | 6/1974 | Searcy et al. | 98/36 |
| 4,085,522 | 4/1978 | Stroszynski | 34/155 X |

*Primary Examiner*—Albert J. Makay
*Assistant Examiner*—William E. Tapolcai, Jr.
*Attorney, Agent, or Firm*—Craig & Antonelli

[57] ABSTRACT

An apparatus for the heat treatment of textile material comprises a plurality of nozzle boxes extending across the operating width at least on one side of the length of material. The nozzle boxes are fed from a front face and have openings discharging in a direction towards the length of material and a fan is disposed at the feed end of these nozzle boxes. The fan is a radial flow fan. It is arranged with its axis of rotation at right angles to the plane of the length of material on the long side of the apparatus.

26 Claims, 8 Drawing Figures

APPARATUS FOR THE HEAT TREATMENT OF TEXTILES

This is a division of application Ser. No. 768,382, filed Feb. 14, 1977, now U.S. Pat. No. 4,137,649 which in turn is a continuation of Ser. No. 463,146 filed Apr. 22, 1974, now abandoned.

This invention relates to an apparatus for the heat treatment of textiles in the form of sheets, bands, webs or the like, and especially to a tenter frame device for the heat treatment of a passing length of material, with nozzle boxes extending across the operating width at least on one side of the length of material. The nozzle boxes are fed from the front face and have blast openings in the direction toward the length of material, and a fan is disposed at the feed side of these nozzle boxes.

A large number of tenter frame constructions has been known. A common feature in all of them is a heat-insulated housing which is passed through by the web of material to be treated while the web is held in chains on both sides, in the longitudinal direction. Transversely above and below the length of material, nozzle boxes are arranged. These nozzle boxes are fed with heated air with the aid of respectively one fan. The air flowing out of the nozzle boxes onto the length of material at a high speed is discharged along the entire nozzle boxes and in parallel thereto, namely in air exhaust ducts formed by nozzle boxes disposed at mutual spacings. The air rebounding from the material then passes via air return ducts back in the direction toward the fan. Previously, the air is regenerated, i.e. reheated by heating units.

The problem in such known devices is the production of high air velocities with a practical arrangement of the fan, which is to be fed with a minimum of energy to obtain a high degree of efficiency. In general, axial-flow fans are used as the fans, arranged above and below the length of material with axes oriented in parallel to the plane of the length of material. In order to obtain high pressure energies, it is necessary to arrange guide means upstream and/or downstream of the axial-flow fans, enlarging the outer dimensions of the fan unit. A disadvantage in this construction resides in high resistances produced, inter alia, by the necessary deflection of the air during intake in the proximity of the fan, in addition to the disadvantageous dimensions.

It is also known to employ radial-flow fans in connection with tenter frames, which advantageously deflect the taken-in air within the fan and exhaust the air at high velocity after deflection by 90°. However, the large dimensions of such fans are disadvantageous, and for this reason the conventional constructions with radial-flow fans are very complicated. The fans are arranged, in such conventional units, either above or below the length of material, with the axis at right angles to the plane of the length of material or along the longitudinal side of the apparatus with an axis oriented in parallel to the length of material.

The heating means are generally arranged directly upstream of the fan on the intake side thereof, so that the air which is accelerated by the fan is not inhibited in its flow by unnecessary resistances.

Especially problematic are constructions where two separate air circuits are required—one above the web and one below the web. This applies, for example, to suspended dryers, and more particularly, to those designed for the thermal treatment of coated webs. In the case of such dryers, the coating mass must not only be dried but also vulcanized, for example, at temperatures of 150°–180° C., while the top side of, for example, the carpet, can only be treated at temperatures up to 90° or 110° C. as otherwise the fibers used therein will be damaged.

This invention is based on the objective of developing an apparatus for the heat treatment of, in particular, coated lengths of textile material, wherein, by an appropriate selection of machine units and by a skillful arrangement of same within the total system, an apparatus is realized which, with a predetermined installed power, based on a given operating width, attains a maximum degree of efficiency, makes it possible to achieve a uniform temperature distribution across the operating width of the material, and wherein, with ready access available to each of the individual machine units, the total apparatus has only minor external dimensions, and wherein, additionally, separate air cycles are provided with respect to the topside and underside of the material.

Starting with the apparatus of the type mentioned hereinabove, the objective of this invention is essentially attained by fashioning the fans used in the apparatus as radial-flow fans and by disposing these fans, with their axes of rotation, at right angles to the plane of the length of material on the longitudinal side of the apparatus.

The thus-obtained advantage resides in the fact that the treatment air returning from the nozzle boxes is deflected by the fan not only by 90°, but immediately by 180°, which is very advantageous for the flow characteristic of the radial-flow fan. Furthermore, the air exiting from the fan is introduced directly into the front face of the nozzle boxes, because suitably the radial-flow fan is arranged with its exhaust apertures at the level and in the immediate proximity of the openings of the nozzle boxes. Thus, the air will flow into the nozzle boxes directly at a high speed without any friction losses and thus will also impinge at high velocity on the material to be treated. This furthermore produces a uniform temperature distribution over the operating width. In this connection, it is advantageous to associate one fan with several nozzle boxes which, together, form a treatment compartment. In general, a heat treatment device of the above-mentioned type is of a greater length, so that several compartments are arranged in series, being transposed alternatingly in mirror-image relationship. In this way, each side of the length of textile material is exposed to the same treatment within the total system. Depending on the purpose for which the textile material is used and on the energy necessary to treat the length of material, the radial-flow fans can be arranged on both sides of the material in the longitudinal direction thereof and also above as well as below the material on one side as well as on both sides.

The above-mentioned constuction requires separate guide ducts for introducing the air as well as discharging the air. The air recycling ducts are avoided, if two of these sections set up in mirror-image relationship and arranged in series to form one compartment of the treatment apparatus, by circulating the treatment medium through these two sections. This increases the degree of efficiency of one compartment. The paths to be traversed in total by the treatment air in the apparatus become shorter, and the kinetic energies are better utilized.

Suitably, the exhaust zone of the nozzle boxes of one section is in communication, for this purpose, solely with the associated radial-flow fan of the adjacent nozzle boxes of the other section of the compartment. Heating units and optionally a lint screen are advantageously disposed between the efflux zone of one section and the radial-flow fan of the other section.

Such a treatment compartment, composed of two sections, forms a compact unit of very small external dimensions which is operative by itself and controllable in dependence on the desired treatment temperature. For this purpose, it is advantageous to provide each of these compartments of a tenter frame device with a fresh-air intake pipe connection and an exhaust-air pipe connection, controllable in their inner cross sections, so that it is possible along the length of the frame device to set at the beginning a different temperature than at the end, or vice versa, depending on the type of treatment to be conducted. Also, a tenter frame device can be lengthened in a simple manner by such a compartment.

In case of tenter frame devices intended for the treatment of coated lengths of textile material, it is advantageous to drive both fans of one side, producing the two individually separated air cycles, by means of a single motor, by joining the drive shaft of this motor together with the axially superimposed radial-flow fans, the intake pipes of which are oriented away from each other. Of course, it is also possible to provide a twin fan in place of two separate fans.

The heating units are advantageously arranged on the intake side of the fans. Furthermore, these units are to be easily accessible, in order to clean them and to be able to rapidly exchange a lint screen which may be provided in front thereof. In order to make this possible, the heating units should be disposed at the inlet of the air return ducts provided on the outside of the apparatus.

In heat treatment devices serving for the heating of coated materials, it is greatly advantageous, as mentioned above, to separate the air streams of the topside and of the underside from each other. For this reason, the invention provides, in a further embodiment, to utilize the length of material, together with walls extending the length of material up to the longitudinal side of the housing, as a separating means between two different air cycles. If, in this case, the heating unit of the topside is of greater power or is differently controlled, then higher temperatures can be attained above the length of material than on the underside of the material, independently of the respective operating width; thus, on the underside, if desired, only great amounts of air need to be generated to carry the length of material through the tenter frame device. This advantage applies even if the two fans required to produce the separate air streams are driven by one motor, as described above.

However, the apparatus as described thus far can be used not only for tenter frame devices, but also for other related apparatus. For example when the apparatus of this invention is set up vertically, it is also advantageously useful as a predrying well or as a hot-flue.

The total construction necessary for this purpose is astonishingly simple and makes it possible to use minimum external dimensions of the total apparatus in a predrying well or chute with equally good outputs as a corresponding tenter frame device. Since radial-flow fans have an extremely flat structure, and these fans are arranged directly adjoining the nozzle boxes, the construction of this invention does not increase the depth of the apparatus due to the fans, although separate air cycle flows are possible for the two sides of the material. The depth dimensions are determined solely by the nozzle boxes and optionally by air recycle ducts. The dimensions in width are not increased by the use of radial-flow fans, either, namely because the necessary motors can be arranged in a niche of the identically constructed, but mirror-image apparatus effective on the other side of the web of material; thus, the motors do not change the depth dimensions of the well, either.

Particularly in case of a drying well wherein the material is not pulled through the well by chains holding the material along the sides, it is important that the material is not shifted laterally by the air streams. For this reason, it is advantageous to arrange the respective treatment compartments at one level on both sides of the length of material in mirror-image transposition, so that the air flowing transversely to the material flows at any level of the length of material, but separated by this length of material, in opposed currents. Consequently, the different force components are compensated for due to the air currents.

The drawing shows an embodiment of the apparatus of this invention. Additional features pertaining to the invention are mentioned in the description of the individual embodiments. These features, as well as the heretofore disclosed technical features, are of inventive significance individually, but in particular in combination, since precisely the simultaneous use of many features mentioned herein results in the apparatus accomplishing the desired objectives.

Figure 1:
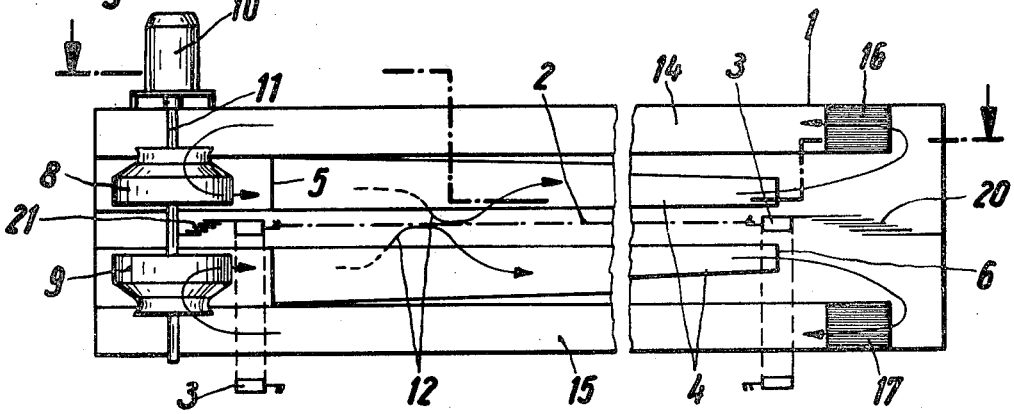
FIG. 1 shows a section transversely through a tenter frame device of this invention.

A tenter frame is surrounded on all sides by a heat-insulated housing 1. The length of textile material 2, held along both longitudinal edges by tension chains 3 with the aid of hooks, extends approximately in the center longitudinally through the apparatus. Advantageously, the tension chains are returned outside of the housing 1, so that the chains neither impede the construction nor affect the construction in its external dimensions. Besides, the chains 3, in the illustrated apparatus, are not restricted in their freedom of movement. They can also be extended past the operating width, possibly to the insulated long side of the housing. The tension chains can also be omitted in the illustrated apparatus. Instead, rollers or conveyor belts can be used as transporting means for the textile material.

Above and below the length of material 2, nozzle boxes 4 are arranged transversely through the longitudinal extension thereof; these boxes are closed at one end face 5 and open at the other end face 6, respective to the material. The nozzle boxes are arranged at mutual spaced intervals—as can be seen from FIGS. 2 and 3—so that air exhaust ducts 7 are formed thereby which are open toward the length of material. On the feed end 5 of the nozzle boxes 4, the fans 8, 9 are disposed, surrounded by helical housings (FIG. 3). The fans are fashioned to be radial-flow fans, the axis of each of these fans extending at right angles to the plane of the length of material. The arrangement is chosen so that the exhaust openings of the fans 8, 9 are disposed in the immediate vicinity of the feed openings 5 of the nozzle boxes 4; accordingly, the air accelerated by the radial-flow fans can enter at high velocity and under great pressure directly into the nozzle boxes. The fans 8, 9, the suction pipes of which are oriented away from one another, are driven by a single motor 10, the drive shaft 11 of which connects both fans 8,9 with each other. The two fans 8,9 can also be constructed as a twin fan.

Figure 2:
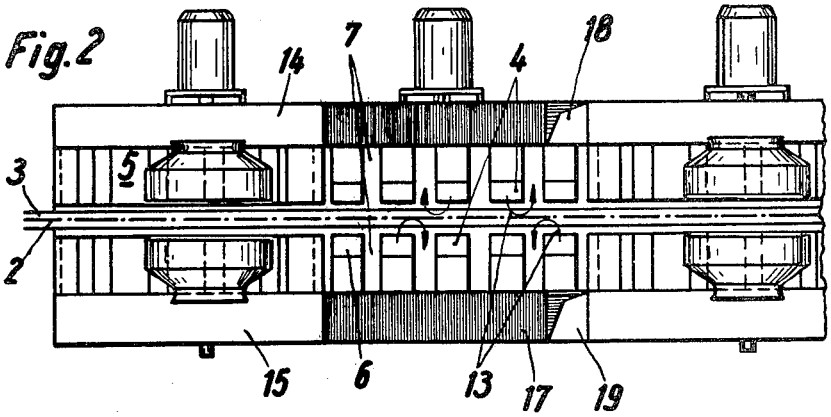
FIG. 2 shows a section longitudinally through the tenter frame device of FIG. 1.
Figure 3:
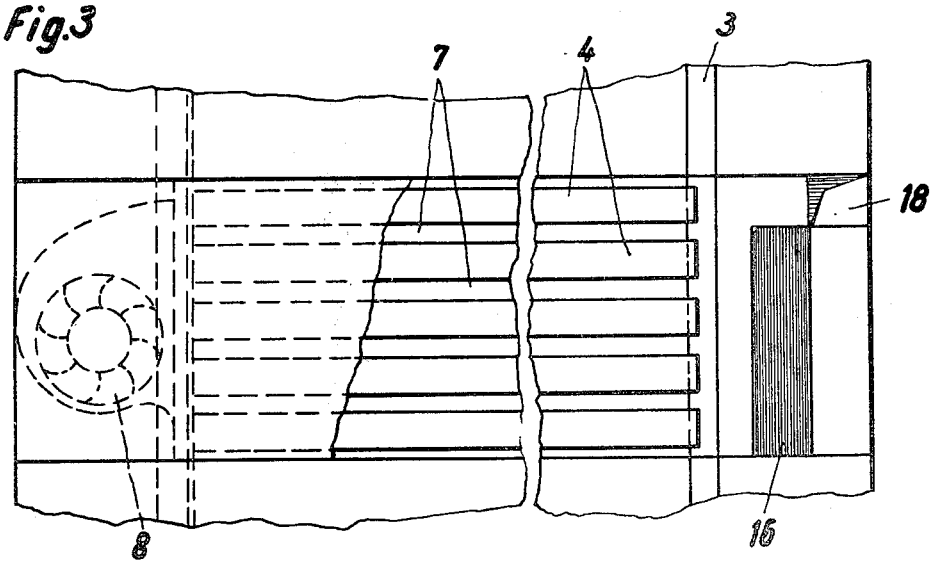
FIG. 3 shows a top view of the tenter frame device of FIG. 1 along section line III—III.

The flow direction of the air accelerated by the fans is shown by several arrows in FIGS. 1 and 2. The air is deflected by 180° in the zone of the fans, made possible by radial-flow fans which have only insubstantial friction losses and a high degree of efficiency. The air entering the nozzle boxes is distributed over the entire length of the boxes and flows, under high pressure, through a plurality nozzle apertures, not shown, onto, i.e. against the length of material 2 in accordance with the arrows 12. The air then rebounds from the material and passes, in accordance with arrows 13 in FIG. 2, into the air exhaust ducts 7, passing to the longitudinal side of the tenter frame facing away from, i.e. opposite the fans, with the direction of flow of the heated air remaining the same.

The air exhaust ducts, one side of which is constituted by the length of material 2, should be equal to or smaller in cross section than the cross section of the nozzle boxes 4, in order to impart to the exhausting air high velocities at right angles to the length of material. Thus, an additional treating effect is attained by the exhausting air. For this purpose, it is advantageous to provide means forming the portion of the air exhaust ducts facing away from the length of material so that the ducts will be closed thereby.

Air return ducts 14, 15 are arranged at the upper and lower outer portions of the apparatus; at the inlets of these ducts, heating units 16, 17 are provided. Thus, the heating means are arranged on the outer portions of the apparatus and are readily accessible from the outside. Suitably, the heating units are passed through by the air along their full widths; for this purpose, in an extension of the air return ducts, space has been left vacant for deflecting the air by 180°.

A tenter frame means consists of several, basically identical, compartments with several series-disposed nozzle boxes fed by a fan. These compartments, arranged one behind the other in the conveying direction of the material, are fashioned to be in alternating mirror-image relationship, as clarified in FIG. 2. Each compartment has an air outlet pipe 18, 19, discharging water-saturated air. Suitably, the outlet pipes are disposed so that the consumed air can exit without flowing through the heating units. The fresh air intake device, however, should be provided so that the taken-in fresh air flows first through the heating units, thereafter to be taken in by the fans.

In the apparatus of FIG. 1, the length of textile material 2 with the chains 3 and the adjoining, telescopically foldable sheet-metal plates 20, 21 forms a barrier between the upper and lower air cycles. For this purpose, the plates 20 connect the chain 3 and/or the edge of the length of material 2 with the outer wall of the housing 1, and the plates 21 connect the other edge of the length of material, for example, with a wall at the level of the fan shaft 11, independently of the respective operating width. By designing the heating units 16, 17 to be different, for example by making unit 16 more powerful, a higher air temperature can be produced above the length of material than underneath the material. This can also be achieved, of course, by an appropriate control of identically designed heating units. Such a separation of the lower and upper air cycles is necessary, in particular, when treating coated lengths of material, where the coating, for curing and vulcanizing, is to reach temperatures of up to 180° C., while the carpet pile, for example made of polypropylene fibers, should not reach temperatures above 90° C.

A separation is also advantageous in case of machines wherein the length of material is to be supported by the lower air current, i.e in the manner of a floating dryer. This advantage, however, is also apparent in tenter frames which are to treat coated material, for example. In this procedure, the essential treatment is to take place on the topside, and for this reason, strictly localized air jets are to impinge at a high pressure from above onto the length of textile material, while the underside is exposed to minimally heated or cold air, merely in order to support the material.

Figure 4:
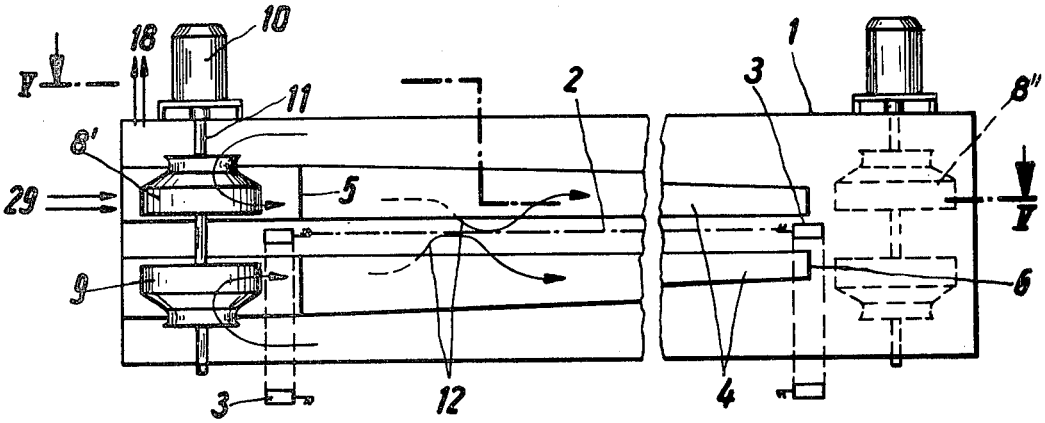
FIG. 4 shows a cross-section through a tenter frame device similar to FIG. 1.
Figure 5:
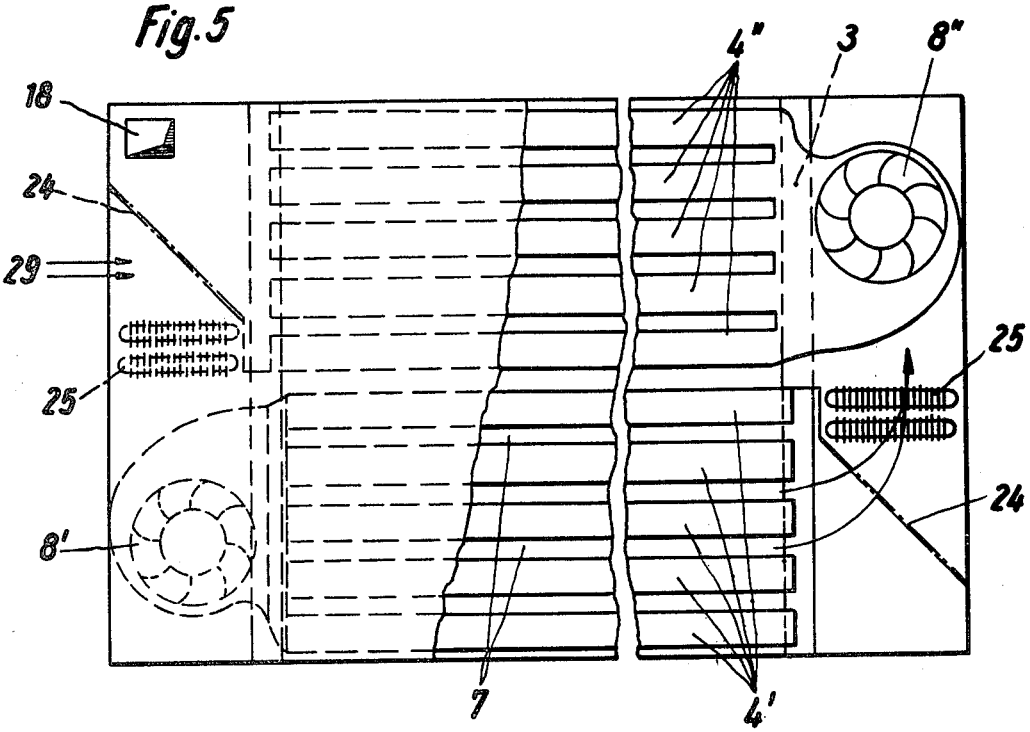
FIG. 5 shows a sectional view along line V—V in FIG. 4.

According to the embodiment of FIGS. 4 and 5, each fan 8', 8'' is associated with five nozzle boxes 4. This number of nozzle boxes forms only a section 4', 4'' of a tenter frame compartment (which as illustrated in FIG. 2 is formed, in total, of two sections 4', 4'' in mirror-image relation to each other), with, respectively, five nozzle boxes 4. The treatment air is circulated in such a compartment. The fan 8' shown on the lefthand side blows the air via the nozzle boxes 4 onto the length of material in accordance with the arrows 12. At that point, the air rebounds and enters the air exhaust ducts 7 between the nozzle boxes 4, where it flows on in the same direction up to the front side of section 4' opposite to the fan 8'. At that point, the treatment air is not deflected by 180° back toward the fan, but rather flows first through a lint screen 24, then through heating units 25, and from there directly into the other section 4'' of the illustrated compartment, then to be taken in by the fan 8'' thereof and be recycled into the five further nozzle boxes 4 back again to the fan 8'. At the end of these nozzle boxes 4, the treatment air is then taken in again by the fan 8'. The air here is also previously cleansed by the lint screen 27 and regenerated, i.e. reheated by the heating units 25.

The simple and optimum circulation of gaseous treatment medium within a compartment is readily apparent from the drawing. A tenter frame device is composed of a plurality of such compartments. Each compartment has its own fresh-air intake pipe 29 and an exhaust air pipe connection 18, in order to be able to control each compartment independently of the adjacent one.

Figure 6:
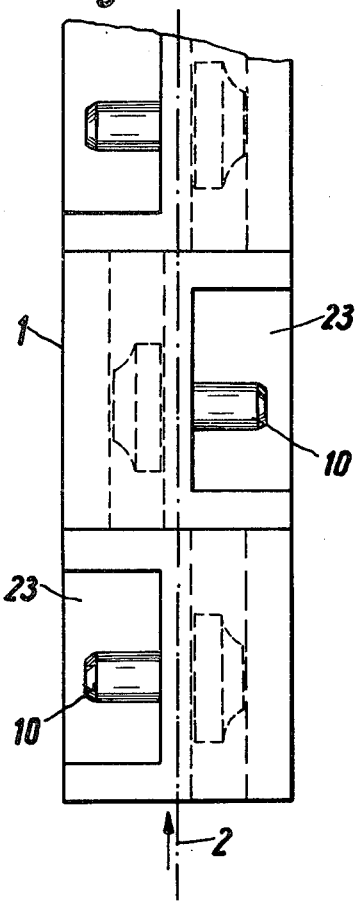
FIG. 6 shows a lateral view of a drying well employing the arrangement of a tentering frame device of this invention.
Figure 7:
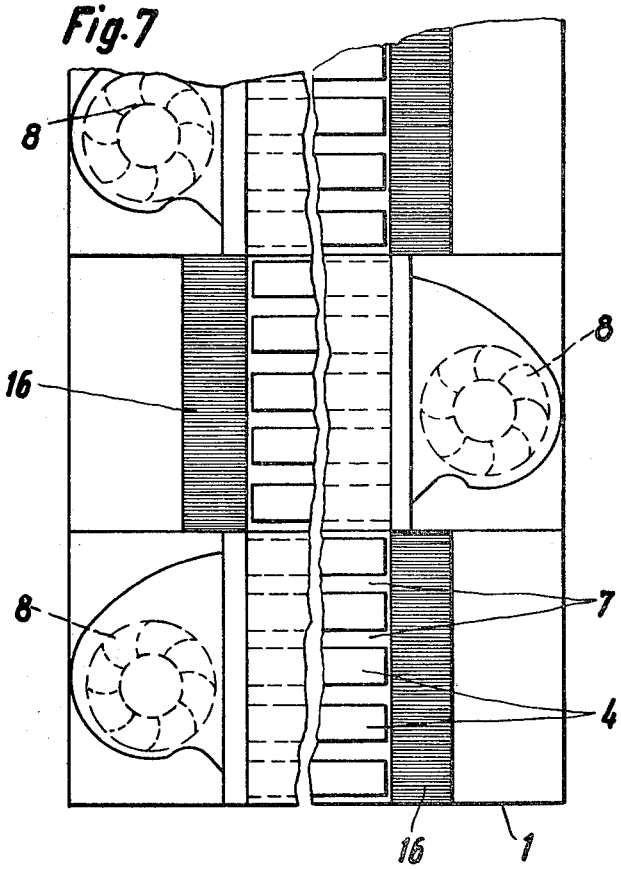
FIG. 7 shows a front view, partially in section, of the drying well according to FIG. 6.
Figure 8:
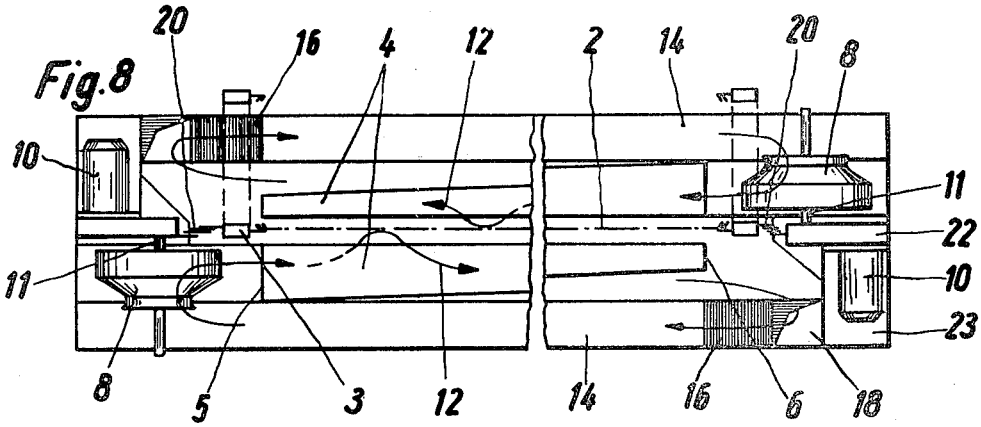
FIG. 8 shows a horizontal section through the drying well according to FIG. 6.

The apparatus of FIGS. 6 to 8 represents a drying well or a part of a hot-flue and, in principle, is identical to the arrangement of FIGS. 1 to 5, except that the apparatus is set up vertically. Therefore, identical reference numerals have been employed for like elements.

It is worth mentioning that the fan 8, the intake pipe connection of which is oriented in the direction toward the outer wall, is driven by a motor 10, the drive shaft 11 of which engages the exhaust side of the fan via a gear unit 22. This drive unit is disposed in a niche or space 23 in the apparatus, which apparatus treats the material from the other side.

The drying well consists of several basically alike compartments with several nozzle boxes arranged side-by-side and fed by a fan. These compartments, superimposed in the conveying direction of the material, are fashioned to be transposed alternatingly in mirror-image relationship, as illustrated by FIGS. 7 and 8. Each compartment has an air exhaust pipe 18 for discharging water-saturated air. Suitably, the outlet pipes are arranged so that the spent air can exit without flowing through the heating units. The fresh-air intake means, however, should be disposed so that the taken-in fresh air flows first through the heating units, then to be taken in by the fans.

The illustrated embodiment shows only one drying well, passed through by the textile material 2 from the bottom toward the top. The same apparatus, or an apparatus of similar structure, is possible if the length of material is passed several times in the upward and downward directions, i.e. as done in a hot-flue.

Such an apparatus, be it a drying well or a hot-flue, can have any other desired drying device, such as particularly a sieve-drum arrangement, connected thereto in the upstream or downstream direction.

While the novel embodiments of the invention have been described, it will be understood that various omissions, modifications and changes in these embodiments may be made by one skilled in the art without departing from the spirit and scope of the invention.

What is claimed is:

1. An apparatus for the heat treatment of textiles, especially for the heat treatment of a passing length of material extending in a plane, which comprises a plurality of sections of nozzle boxes extending across the operating width at least on one side of the length of the material, said nozzle boxes being fed from a front face and having openings discharging in a direction toward the length of material, a fan being disposed at the feed end of these nozzle boxes for introducing a gaseous treatment medium into said nozzle boxes, said fan being a radial-flow fan and being arranged, with its axis of rotation, at right angles to the plane of the length of material on a longitudinal side of the apparatus, two sections of said nozzle boxes and associated radial fans being arranged adjacent to each other in a mirror-image transpositional relationship and being disposed in series communication with each other to form a treatment compartment wherein the gaseous treatment medium is circulated through said two sections.

2. The apparatus according to claim 1, in which the radial-flow fan is arranged with its exhaust openings at the level of the feed openings of the nozzle boxes.

3. The apparatus according to claim 2, in which the radial-flow fan is arranged with its exhaust openings in the immediate vicinity of the feed openings of the nozzle boxes.

4. The apparatus according to claim 1, in which an exhaust zone of the nozzle boxes of one section is connected only with an associated radial-flow fan of the adjacent nozzle boxes of the other section of the compartment.

5. The apparatus according to claim 1, in which heating units and optionally a lint screen are disposed between the exhaust zone of one section and the radial-flow fan of the other section.

6. The apparatus according to claim 1, in which each compartment is associated with a fresh-air intake means and an exhaust air pipe means of variable opening cross section.

7. The apparatus according to claim 6, in which the fresh-air intake means is arranged, in the cycle of the treatment medium, upstream of the heating unit and downstream of a lint screen.

8. The apparatus according to claim 1, characterized in that fans are arranged not only on one side of a treatment compartment but on both sides.

9. The apparatus according to claim 1, in which a radial-flow fan is disposed on both sides of the length of material in order to treat coated lengths of material.

10. The apparatus according to claim 9, in which two radial-flow fans are arranged one above the other, each fan having an air intake pipe means, the intake pipe means of said fans facing away from each other.

11. The apparatus according to claim 10, in which the two radial-flow fans are attached to a shaft and are driven by a motor.

12. The apparatus according to claim 11, in which the two fans are combined to a twin fan.

13. The apparatus according to claim 9, in which the fans are connected with, respectively, one drive means which, in a floating dryer, are independently drivable at different speeds.

14. The apparatus according to claim 13, in which a fan at the topside of the material, in conjunction with the air outlet openings of the nozzle boxes, produces high air pressures with strong air jets, while a fan at the underside of the material, in conjunction with the air outlet openings of the nozzle boxes, produces a large amount of air to obtain a supporting effect.

15. The apparatus according to claim 1, in which said nozzle boxes extend transversely across the length of material, and are spaced from each other, air exhaust ducts being formed by said nozzle boxes and arranged in parallel thereto, the air exhaust ducts at the topside of the length of material are in total fashioned to be open over their surface facing the length of material, and the cross section of the air exhaust ducts being formed to be equal to or smaller than the cross section of the nozzle boxes.

16. The apparatus according to claim 15, in which the air exhaust ducts are fashioned to be closed in the direction of the side facing away from the length of material.

17. The apparatus according to claim 1, further comprising endless tension chains laterally guiding the textile material in a tentering frame device, said tension chains being moveable past the operating width.

18. The apparatus according to claim 17, in which the chains are returned outside of a housing of said apparatus.

19. An apparatus for the heat treatment of a moving length of textile material arranged to extend in a plane, which comprises a plurality of nozzle boxes extending across each of the two sides of the operating width of the length of textile material, fan means for supplying heated air to said plurality of nozzle boxes, said nozzle boxes having feed openings at one end for entry of said air and having openings discharging the heated air in a direction toward the textile material, said fan means including a radial-flow fan, on each side of the operating width of the length of textile material, having exhaust openings disposed at the level and in the immediate vicinity of the feed openings of said plurality of nozzle boxes, each fan being associated with a number of adjacent nozzle boxes for introducing heated air thereto and for providing a section of nozzle boxes and being arranged, with its axis of rotation, at right angles to the plane of the length of textile material on one longitudinal side of the apparatus whereby said heated air is introduced directly into the associated number of the nozzle boxes from said one longitudinal side parallel to the plane of said length of textile material, means for exhausting the air discharged from said associated number of nozzle boxes at the other longitudinal side of the apparatus, heating means for heating the exhausted air, and two sections of the associated nozzle boxes being arranged adjacent to each other in a mirror-image relationship, transpositional with the means for exhausting the heated air from one section of associated nozzle boxes being in communication with the fan of the other section of associated nozzle boxes, the two sections of nozzle boxes thereby being disposed in series communication to form a treatment chamber wherein the heated air is circulated through said two sections of nozzle boxes.

20. An apparatus for the heat treatment of a textile material arranged to extend in a plane, especially for the heat treatment of a passing length of textile material, which comprises nozzle boxes extending across the operating width on both sides of the length of textile material, said nozzle boxes being fed with heated air through openings at front end faces and having openings discharging the heated air in a direction toward the length of textile material, two radial-flow fans being arranged one above the other on on both sides of said textile material and attached to a shaft driven by a motor, each fan having an air intake means and air discharge means and each fan being disposed with the air discharge means adjacent to the feed openings of a section of adjacent nozzle boxes and being arranged with its axis of rotation at right angles to the plane of the length of textile material on one longitudinal side of the apparatus whereby said heated air is introduced directly into a section of adjacent nozzle boxes, associated with each fan, from said longitudinal side parallel to the plane of said length of textile material and means on the other longitudinal side of the apparatus causing heated air deflected from the textile material to flow over the textile material and to return to a fan on said one longitudinal side, two of said sections of the adjacent nozzle boxes being arranged in mirror-image transpositional relationship and being disposed in series communication with each other to form a treatment compartment wherein the heated air is circulated through said two sections of nozzle boxes.

21. The apparatus according to claim 20, further comprising heater means arranged upstream of each radial-flow fan for heating the air prior to the heated air being passed through a radial-flow fan, said heater means being positioned in the apparatus at a location which is spaced from and outside of the operating width of the textile material whereby said textile material is heated solely by the heated air flowing over the textile material.

22. The apparatus of claim 20, wherein said means on the other longitudinal side of the apparatus includes a discharge opening through which the air is passed before being returned to a fan on said one longitudinal side, said opening being positioned on the same side of the operating width of the length of textile material as the fan to which the heated air is returned.

23. The apparatus of claim 20, wherein said means on the other longitudinal side of the apparatus further includes a radial-flow fan arranged with its axis of rotation at right angles to the plane of the length of textile material on the other longitudinal side of the apparatus downstream of said discharge opening.

24. The apparatus of claim 22, further comprising heater means located in said discharge opening for providing additional heat to said heated air prior to the heated air being returned to said one longitudinal side of the apparatus.

25. The apparatus according to claim 20, wherein the two fans are combined in a twin fan assembly.

26. The apparatus according to claim 20, further comprising a heating unit that is readily accessible from the outside of said apparatus, said heating unit being arranged at the inlet of an air return duct disposed on the outer portion of said apparatus.

* * * * *